US009368260B2

(12) United States Patent
Varkey et al.

(10) Patent No.: US 9,368,260 B2
(45) Date of Patent: Jun. 14, 2016

(54) CABLE OR CABLE PORTION WITH A STOP LAYER

(75) Inventors: Joseph Varkey, Sugar Land, TX (US); Jushik Yun, Sugar Land, TX (US); Burcu Unal, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 285 days.

(21) Appl. No.: 13/702,919

(22) PCT Filed: Jun. 9, 2011

(86) PCT No.: PCT/US2011/039879

§ 371 (c)(1), (2), (4) Date: Apr. 26, 2013

(87) PCT Pub. No.: WO2011/156659

PCT Pub. Date: Dec. 15, 2011

(65) Prior Publication Data

US 2013/0206314 A1 Aug. 15, 2013

Related U.S. Application Data

(60) Provisional application No. 61/397,255, filed on Jun. 9, 2010.

(51) Int. Cl.

| | |
|---|---|
| ***H01B 13/26*** | (2006.01) |
| ***H01B 7/29*** | (2006.01) |
| *H01B 7/04* | (2006.01) |

(52) U.S. Cl.

CPC ..... *H01B 13/2613* (2013.01); *H01B 7/292* (2013.01); *H01B 7/046* (2013.01)

(58) Field of Classification Search

CPC ..... H01B 7/046; H01B 7/292

USPC ..... 156/51, 52

See application file for complete search history.

(56) References Cited

U.S. PATENT DOCUMENTS

| | | | | |
|---|---|---|---|---|
| 3,259,675 | A | 7/1966 | Bowers | |
| 3,634,607 | A | 1/1972 | Coleman | |
| 4,729,629 | A | 3/1988 | Saito et al. | |
| 5,930,431 | A | 7/1999 | Lail et al. | |
| 7,288,721 | B2 * | 10/2007 | Varkey et al. | 174/102 R |

(Continued)

FOREIGN PATENT DOCUMENTS

| | | | |
|---|---|---|---|
| CN | 2755741 | Y | 2/2006 |
| CN | 201327731 | Y | 10/2009 |

(Continued)

OTHER PUBLICATIONS

Extended European Search Report for EP Application No. 117933206.1 dated Nov. 28, 2014.

International Search Report for PCT Application Serial No. PCT/US2011/039879 dated Jan. 16, 2012.

*Primary Examiner* — Jeff Aftergut

(57) ABSTRACT

An embodiment of a method for manufacturing a cable, comprises providing a cable core comprising at least one conductor therein, extruding a stopping layer about at least the cable core, extruding a jacketing layer about the stopping layer, and cabling at least one armor wire layer about the jacketing layer to form the cable, wherein the stopping layer comprises a polymer layer configured to mechanically and thermally protect the cable core.

13 Claims, 6 Drawing Sheets

(56) References Cited

U.S. PATENT DOCUMENTS

| | | | | |
|---|---|---|---|---|
| 2006/0151194 | A1 | 7/2006 | Varkey et al. | |
| 2006/0242824 | A1 * | 11/2006 | Varkey et al. | 29/825 |
| 2009/0194314 | A1 | 8/2009 | Varkey et al. | |
| 2009/0283295 | A1 | 11/2009 | Varkey et al. | |

FOREIGN PATENT DOCUMENTS

| | | | |
|---|---|---|---|
| CN | 201413731 | Y | 2/2010 |
| JP | 2002243999 | A | 8/2002 |
| JP | 2003151375 | A | 5/2003 |

* cited by examiner

CABLE OR CABLE PORTION WITH A STOP LAYER

BACKGROUND

The statements in this section merely provide background information related to the present disclosure and may not constitute prior art The present disclosure is related in general to wellsite and wellbore equipment such as oilfield surface equipment, downhole wellbore equipment and methods, and the like.

Standard wireline cables, such as a cable 10 shown in FIG. 1 or a cable 20 shown in FIG. 2, may be prone to deformation when the wireline cable is bent under tension (for example, when cables go over an object 11 such as a sheave, at cross-over points on drums, or in deviated wells). An example of such a deformation is shown in FIG. 1. When bent under tension, the cable 10 may be compressed into a substantially oval shape or profile, as compared to an original round shape or profile, indicated by a line 13 and shown in FIG. 1. The cable core 12 may undergo a similar deformation and the materials of the cable core 12 may creep into gaps between the cable core 12 and armor wires 14.

Insulation creep may also occur as a result of compressive forces caused by torque imbalance between the inner 22 and outer 24 armor wire layers when the cable 20 is under tension, as shown in FIG. 2. As shown in FIG. 2, when longitudinal stress (A) is placed on the cable 20, the longitudinal stress causes the inner 22 and outer 24 armor wire layers (which are placed on the cable at opposite lay angles) to rotate against each other (B). Both armor wire layers may tend to constrict (C) against the cable core 26.

It remains desirable to provide improvements in wireline cables and/or downhole assemblies.

SUMMARY

An embodiment of a method for manufacturing a cable, comprises providing a cable core comprising at least one conductor therein, extruding a stopping layer about at least the cable core, extruding a jacketing layer about the stopping layer, and cabling at least one armor wire layer about the jacketing layer to form the cable, wherein the stopping layer comprises a polymer layer configured to mechanically and thermally protect the cable core. Extruding a stopping layer may comprise extruding a polymeric layer of Polyarylether ketone families comprising, PolyEtherEtherlKetone (PEEK), PolyEtherKeton (PEK), PolyKetone (PK), or polyaryletherketone (PAEK), and combinations thereof. Extruding a jacketing layer may comprise extruding a fluoropolymer, wherein the fluropolymer comprises ethylene-tetrafluoroethylene copolymer (ETFE), TFE/Perfluoromethylvinylether Copolymer (MFA), ethylene-chlorotrifluoroethylene copolymer (ECTFE), perfluoroalkoxy resin (PFA), fluorinated ethylene propylene copolymer (FEP), polytetrafluoroethylene (PTFE), and combinations thereof.

In an embodiment, cabling comprises at least partially embedding the at least one armor wire layer into the jacketing layer. Embedding may comprise embedding the at least one armor wire layer into the jacketing layer while the jacketing layer is soft. In an embodiment, the method further comprises extruding a jacketing layer about the armor wire layer. In an embodiment, the method further comprises extruding an outer stopping layer about the armor wire layer and may further comprise extruding at least one jacketing layer over the outer stopping layer. In an embodiment, cabling comprises cabling at least one of a solid armor wire layer and a stranded armor wire layer. In an embodiment, a one of extruding a stopping layer and extruding a jacketing layer comprises extruding an amended polymer material, wherein the polymer material is amended with a plurality of strengthening members. The strengthening members may comprise at least one of a wear-resistant particle and a fiber.

In an embodiment, providing a cable core comprises providing a one of a monocable, a coaxial cable, a triad cable, a quad cable, and a heptacable. In an embodiment, the cable comprises a wireline cable configured for use in a wellbore penetrating a subterranean formation. In an embodiment, the stopping layer is configured to protect the cable core from damage at an exposure about 500 to about 600 degrees Fahrenheit. In an embodiment, the method further comprises cabling an outer armor wire layer about the armor wire layer and may further comprise extruding a second jacketing layer about the at least one armor wire layer prior to cabling the outer armor wire layer and may further comprise extruding a stopping layer over the second jacketing layer prior to cabling the outer armor wire layer.

An embodiment of a method for manufacturing a cable portion, comprises providing a cable core portion comprising at least one conductor therein, extruding a stopping layer over at least the cable core portion, extruding a jacketing layer about the stopping layer, and cabling at least one armor wire layer about the jacketing layer to form the cable portion, wherein the stopping wire layer comprises a polymer layer configured to mechanically and thermally protect the cable core portion and wherein the cable portion comprises a caged armor wire. In an embodiment, extruding a stopping layer comprises extruding a polymeric layer of Polyarylether ketone families comprising, PolyEtherEtherlKetone (PEEK), PolyEtherKeton (PEK), PolyKetone (PK), or polyaryletherketone (PAEK), and combinations thereof. In an embodiment, extruding a jacketing layer comprises extruding a fluoropolymer, wherein the fluropolymer comprises ethylene-tetrafluoroethylene copolymer (ETFE), TFE/Perfluoromethylvinylether Copolymer (MFA), ethylene-chlorotrifluoroethylene copolymer (ECTFE), perfluoroalkoxy resin (PFA), fluorinated ethylene propylene copolymer (FEP), polytetrafluoroethylene (PTFE), and combinations thereof.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
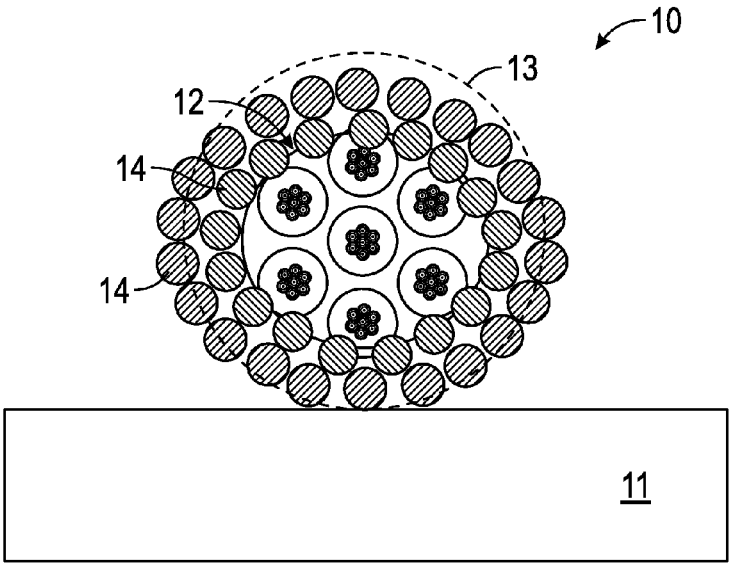
FIG. 1 (Prior Art)
FIG. 1 is a schematic cross-sectional view of a prior art cable disposed against an object.
Figure 2:
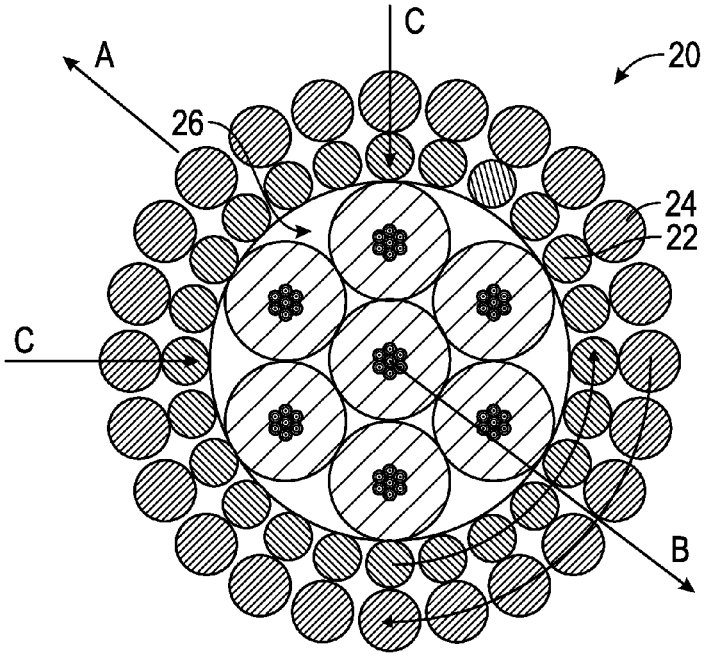
FIG. 2 (Prior Art)
FIG. 2 is a schematic cross-sectional view of a prior art cable.
Figure 3A:
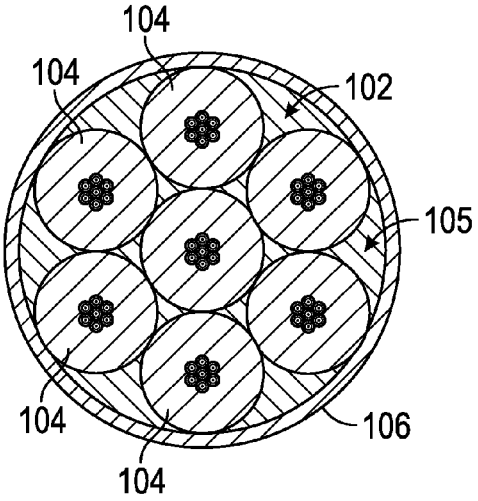
FIGS. 3*a*-3*c* are schematic cross-sectional views, respectively, of an embodiment of a cable.
Figure 3B:
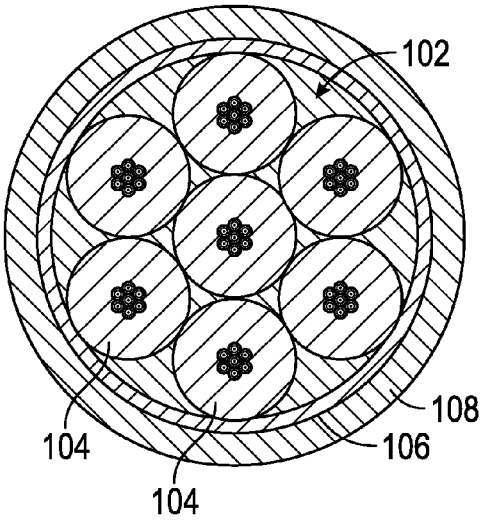
Figure 3C:
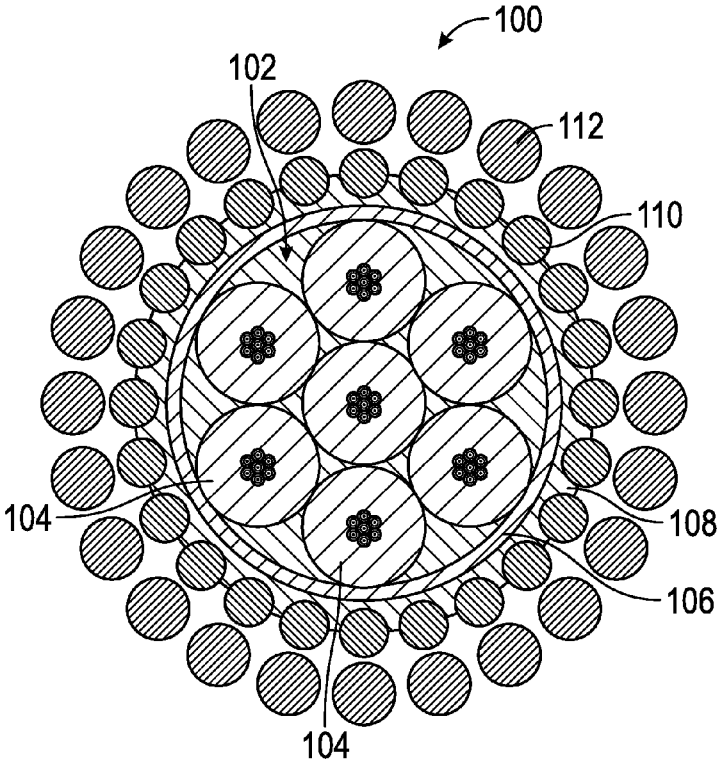

Referring now to FIGS. 3*a* through 3*c*, an embodiment of a cable is indicated generally at 100 in FIG. 3*c*. The cable 100 may comprise a wireline cable configured for use in a wellbore penetrating a subterranean formation or any suitable cable. The cable 100 comprises a cable core 102 comprising at least one conductor 104 encased in an insulating material 105 to form the cable core 102. While the cable core 102 illustrated in FIG. 3 comprises seven conductors 104 to form a heptacable core 102, those skilled in the art will appreciate that the cable core 102 may comprise a variety of cable core types including monocable (comprising a single conductor, such as the conductor 104), coaxial cable (comprising a single conductor 104 and an axial serve layer), triad cables (comprising a three conductors 104), quad cables (comprising a four conductors 104), or the like. A polymeric stopping layer 106, discussed in more detail below, is disposed around and surrounds the cable core 102. A polymeric jacketing layer 108, best seen in FIG. 3*b* and discussed in more detail below, is disposed around and surrounds the stopping layer 106. An inner armor wire layer 110 and an outer armor wire layer 112, best seen in FIG. 3*c*, are disposed about the jacketing layer 108 to form the cable 100.

The stopping layer 106 may be extruded over the completed cable core 102. The stopping layer 106 comprises polymers that are selected for their high strength and heat-resistance material characteristics. The polymer materials for the stopping layer 106 may comprise, but are not limited to, Polyarylether ketone families such as, PolyEtherEtherlKetone (PEEK), PolyEtherKeton (PEK), PolyKetone (PK), or polyaryletherketone (PAEK). Any of the above-mentioned stopping layer polymer materials may also be strengthened by amending the polymer with a strengthening member such as wear-resistant particles and/or fibers, such as short fibers. The wear-resistant particles may comprise, but are not limited to, reinforcing additives such as micron sized PTFE, Graphite, Ceramer™, etc. The short fibers may comprise carbon, glass, aramid or any other suitable natural or synthetic material. The polymer material of the stopping layer may comprise any other suitable polymer possessing the desired characteristics of creating a durable, high-temperature-resistant jacket having strength and heat resistance.

The jacketing layer 108 comprises a polymer (which may be a pure or a polymer amended with short fibers and/or wear-resistant particles) and may be extruded over the stopping layer 106. The polymer material(s) for the jacketing layer 108 may comprise, but is not limited to, fluoropolymers, such as ethylene-tetrafluoroethylene copolymer (ETFE), TFE/Perfluoromethylvinylether Copolymer (MFA), ethylene-chlorotrifluoroethylene copolymer (ECTFE), perfluoroalkoxy resin (PFA), fluorinated ethylene propylene copolymer (FEP), polytetrafluoroethylene (PTFE). Any of the above-mentioned polymers for the jacketing layer 108 may also be strengthened by amending the polymer with wear-resistant particles and/or short fibers. Wear-resistant particles may comprise, but are not limited to, reinforcing additives such as micron sized PTFE, Graphite, Ceramer™, etc. Short fibers may comprise carbon, glass, aramid or any other suitable natural or synthetic material. The polymer material for the jacketing layer 108 may comprise any other suitable polymer possessing the desired characteristics.

The cable 100 may be formed by extruding the stopping layer 106 over the cable core 102 in order to prevent the inner armor wires 110 from coming into contact with and damaging or shorting against the conductors 104 in the cable core 102. The jacketing layer 108 of the jacketing polymer may be extruded over the stopping layer 106 and the inner armor wires 110 is cabled helically about and slightly or partially embedded into the jacketing layer 108 polymer while the polymer of the jacketing layer 108 is soft or immediately after applying an infrared heat source to slightly soften the surface of the jacketing layer 108. The jacketing layer 108 helps maintain circumferential spacing between the individual elements of the inner armor wire layer 110. The outer layer 112 of armor wire strength members is cabled helically over the inner layer 110 at a lay angle opposite to the lay angle of the inner layer 110.

Figure 4A:
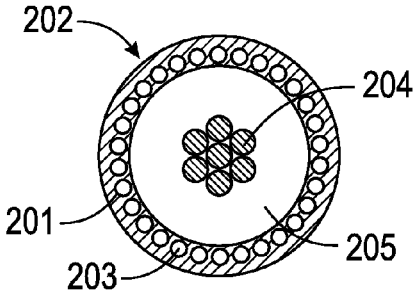
FIGS. 4*a*-4*g* are schematic cross-sectional views, respectively, of an embodiment of a cable.
Figure 4B:
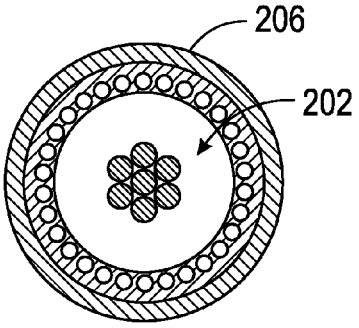
Figure 4C:
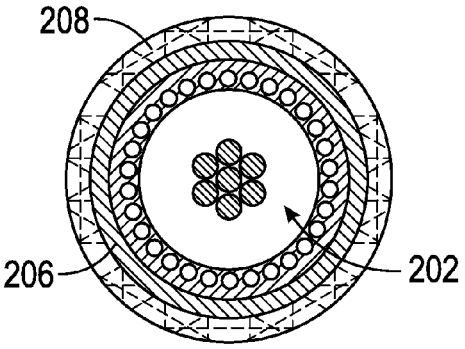
Figure 4D:
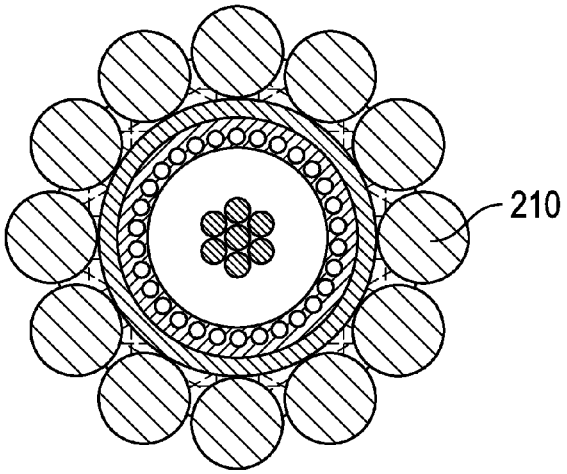
Figure 4E:
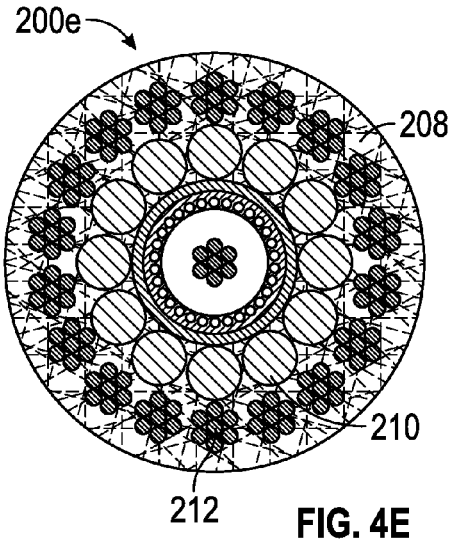
Figure 4F:
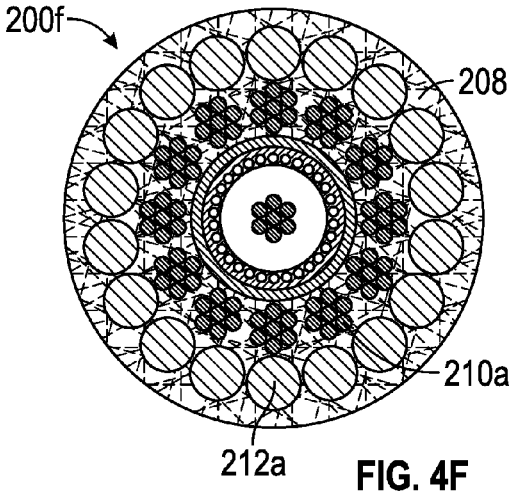
Figure 4G:
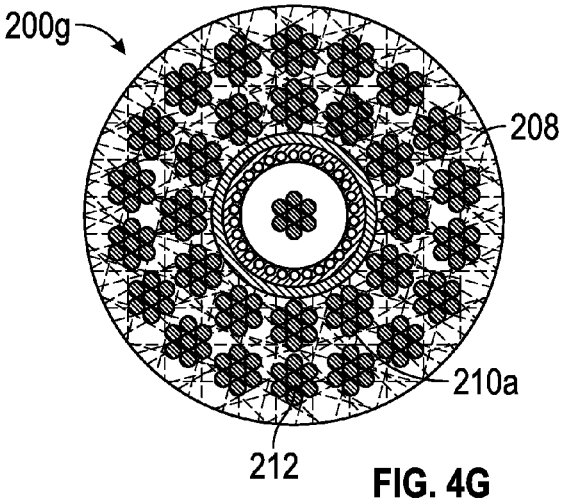

Referring now to FIGS. 4*a*-4*g*, an embodiment of a cable is indicated generally at 200*e* in FIG. 4*e*, at 200*f* in FIG. 4*f*, and at 200*g* in FIG. 4*g*. The cable 200*e*, 200*f*, or 200*g* may comprise a wireline cable configured for use in a wellbore penetrating a subterranean formation or any suitable cable. The cable 200*e*, 200*f*, or 200*g* comprises a cable core 202 comprising at least one conductor 204 encased in an insulating material 205 and a serve layer 203 encased in an insulating material 201 to form the cable core 202. A polymeric stopping layer 206, similar to the stopping layer 106 in FIGS. 3*a*-3*c*, is disposed around and surrounds the cable core 202. A layer of polymeric jacketing material 208, best seen in FIG. 4*c* and similar to the jacketing layer 108 in FIGS. 3*b* and 3*c*, is disposed around and surrounds the stopping layer 206. An inner armor wire layer 210 and an outer armor wire layer 212, best seen in FIG. 4*e*-4*g*, are disposed about the jacketing layer 208. The inner armor wire layer may comprise solid strength members 210, such as those shown in FIGS. 4*d* and 4*e*, or stranded wire strength members 210*a* shown in FIGS. 4*f* and 4*g*. The outer armor wire layer may comprise solid strength members 212, such as those shown in FIG. 4*f*, or stranded wire strength members 212*a* shown in FIGS. 4*e* and 4*g*. The armor wire layers 210 and 212 are completely embedded in a continuously bonded polymeric jacketing system comprising a plurality of layers of the polymeric jacketing material 208 with a smooth, easily sealable outer profile to form a caged cable 200*e*, 200*f*, or 200*g*.

The cables 200*e*, 200*f*, or 200*g* may be formed by alternating layers of extruded polymer material 208 and cabled strength members 210, 210*a*, 212, 212*a* are applied. As each layer of polymer 208 is extruded, the cable core 202 is exposed to high temperatures that can potentially damage the components or conductors 204 within the cable core 202. By applying the heat-resistant stopping layer 206 over the cable core 202, the potential for heat damage to the cable core 202 during subsequent polymer layer extrusion may be greatly minimized and helps to isolate the serve 203 from armor 210, 210*a*, 212, 212*a* in cables 200*e*, 200*f*, or 200*g*. As shown in FIG. 6, the manufacturing concept is as follows:

The jacketing layer 208 may comprise chemically and physically or mechanically protective fluoropolymer (as described above). The inner layer 210, 210*a* of armor wire strength members is cabled over and partially embedded into the jacketing layer 208 before the jacketing layer 208 is set or immediately after partially melting the jacketing layer 208 using an infrared heat source. As shown in FIGS. 4*e*-4*g*, additional layers of the jacketing layer polymer 208 and armor wires 212, 212*a* complete the cable 200*e*, 200*f*, 200*g*.

Figure 5A:
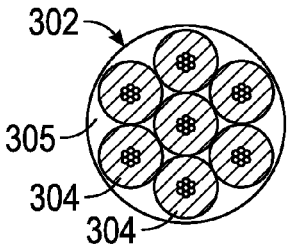
FIGS. 5*a*-5*h* are schematic cross-sectional views, respectively, of an embodiment of a cable.
Figure 5B:
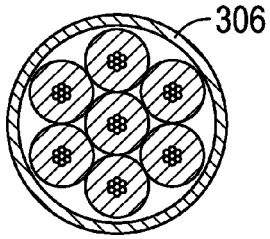
Figure 5C:
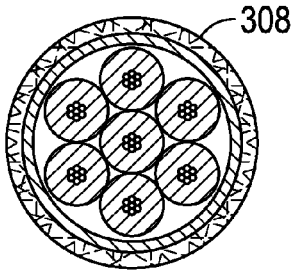
Figure 5D:
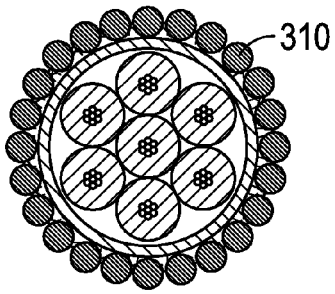
Figure 5E:
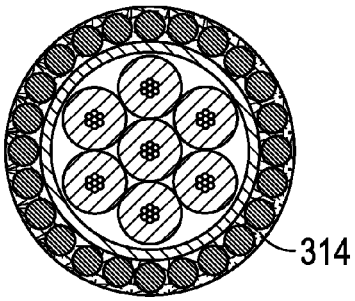
Figure 5F:
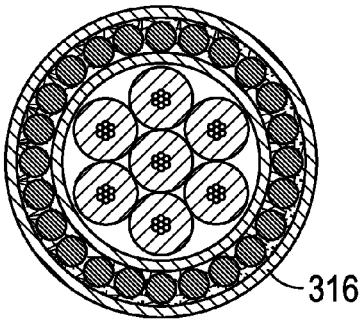
Figure 5G:
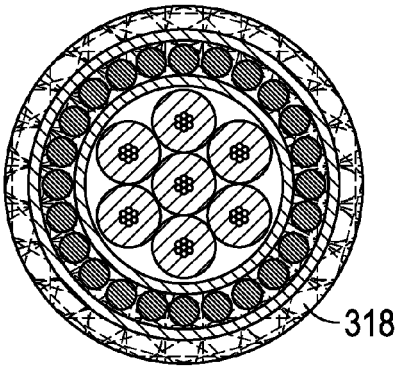
Figure 5H:
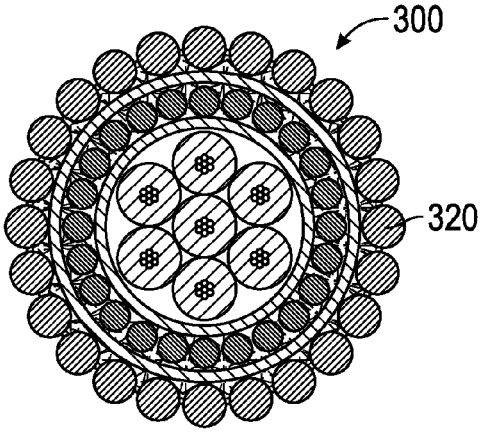

Referring now to FIGS. 5*a*-5*h*, an embodiment of a cable is indicated generally at 300 in FIG. 5*h*. The cable 300 may comprise a wireline cable configured for use in a wellbore penetrating a subterranean formation or any suitable cable. The cable 300 comprises a cable core 302 comprising at least one conductor 304 encased in an insulating material 305 to form the cable core 302.

A polymeric stopping layer 306, similar to the stopping layer 106 in FIGS. 3*a*-3*c*, is disposed around and surrounds the cable core 302. A polymeric jacketing layer 308, best seen in FIG. 6*c* and similar to the jacketing layer 108 in FIGS. 3*b* and 3*c*, is disposed around and surrounds the stopping layer 306. An inner armor wire layer 310 best seen in FIG. 3*c*, are disposed about the jacketing layer 308. A polymeric jacketing layer 314 is disposed around the inner armor wire layer 310. A polymeric stopping layer 316 is disposed around and surrounds the jacketing layer 314. A polymeric jacketing layer 318 is disposed around the stopping layer 316. An outer armor wire layer 320 is disposed about the jacketing layer 318 to form the cable 300.

The stopping layer 306 (as described above) is extruded over the cable core 302 to isolate the armor wires 310 from the components in the cable core 302, and to keep the armor wires 310 from collapsing to a point where the layer 310 reaches 100% percent coverage. The stopping layer 306 is followed by the inner armor wires 310, which are encased in a physically and chemically protective jacketing polymer (as described above) 314. The second stopping layer 316 is then extruded over the jacketing polymer layer 314 covering the inner armor wire layer 310. The second stopping layer 316 isolates the inner 310 and outer 320 armor wire layers from each other to substantially eliminate damage from point-to-point contact between the inner 310 and outer 320 armor wires, which may be advantageous when the cable 300 is utilized as a high tension cable, as will be appreciated by those skilled in the art. The outer wires 320, embedded in a physically and chemically protective jacketing polymer 318, are placed over the second stopping layer 316. The outer armor wire layer 320 may be encased in the polymer jacket layer 318, as will be appreciated by those skilled in the art.

The cable 300 may be constructed by providing the cable core 302, extruding the stopping layer 306 over the cable core 302, and extruding a layer 308 of physically and chemically protective jacketing polymer over the inner stopping layer 306. While the jacketing polymer 308 is still soft or after softening it by using an infrared heat source, the inner layer of armor wires 310 is cabled over and partially embedded into the jacketing polymer 310. An additional layer of jacketing polymer 314 is extruded over the inner armor wires 310 to create a substantially circular profile. The second, outer stopping layer 316 is extruded over the jacketing polymer 314 covering the inner armor wire layer 310. A layer 318 of physically and chemically protective jacketing polymer is extruded over the outer stopping layer 316. While the outer jacketing polymer layer 318 is still soft or after softening it using an infrared heat source, the outer layer of armor wires 320 is cabled onto and partially or fully embedded into the jacketing polymer 318.

Figure 6A:
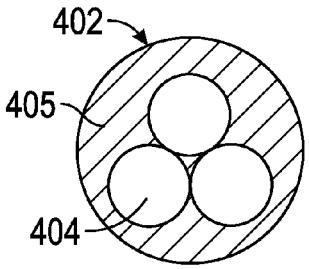
FIGS. 6*a*-6*e* are schematic cross-sectional views, respectively, of an embodiment of a cable.
Figure 6B:
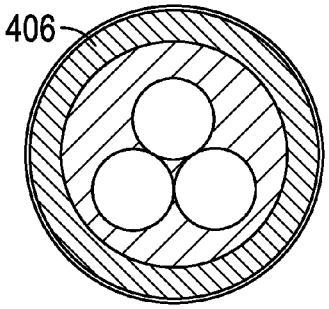
Figure 6C:
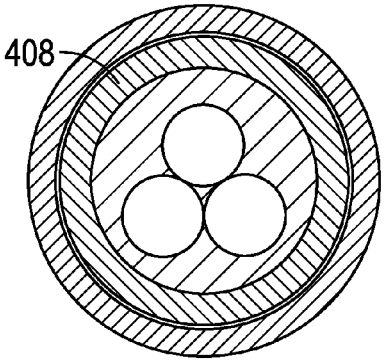
Figure 6D:
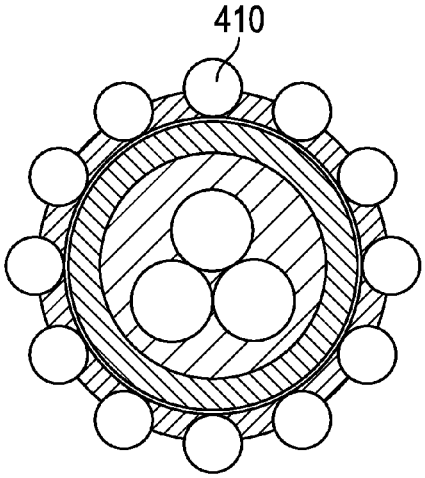
Figure 6E:
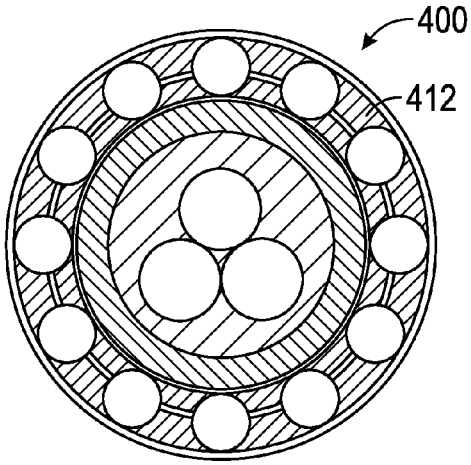

Referring now to FIGS. 6*a*-6*e*, an embodiment of a caged armor wire strength member is indicated generally at 400 in FIG. 6*e*. The strength member 400 comprises an inner armor wire layer 402 comprising at least one conductor 404 encased in an insulating material 405 to form the inner armor wire layer 402.

A polymeric stopping layer 406, similar to the stopping layer 106 in FIGS. 3*a*-3*c*, is disposed around and surrounds the inner armor wire layer 402. A polymeric jacketing layer 408, best seen in FIG. 6*c* and similar to the jacketing layer 108 in FIGS. 3*b* and 3*c*, is disposed around and surrounds the stopping layer 406. An outer armor wire layer 410 best seen in FIG. 3*c*, are disposed about the jacketing layer 408. A polymeric jacketing layer 412 is disposed around and encases the inner armor wire layer 410.

The strength member 400 may be constructed by providing the inner armor wire layer 402, extruding the stopping layer 406 over the inner armor layer 402, and extruding the layer 408 of physically and chemically protective jacketing polymer over the stopping layer 406. While the jacketing polymer 408 is still soft or after softening it by using an infrared heat source, the second layer of armor 410 is cabled over and partially embedded into the jacketing polymer layer 408. A layer 412 of polymer jacketing layer is extruded over armor wire layer 410. The strength member 400 may be utilized as a single member of an armor wire layer in a cable, such as a member of the armor wire layers 110 and 112 of the cable 100, the armor wire layers 210, 210*a*, 212, and 212*a* of the cables 200*e*, 2004, and 2006, and the armor wire layers 310 and 320 of the cable 300. The strength member 400 may additionally be utilized for transmitting power and/or telemetry, as the conductors 404 of the inner armor wire layer 402 are electrically insulated from the individual members of the armor wire layer 410. In a non-limiting example, a signal may be sent in one direction along the conductors 404 and return on the armor wire layer 410, as each of the armor wire layers 402 and 410 are electrically insulated from the other and encased in a polymer material. In a non-limited example, the strength member 400 may comprise one member of an armor wire layer, such as the armor wire layer 310 of the cable 300 and the strength member 400 may comprise one member of another layer The embodiments disclosed herein comprise a wireline cable comprising one or more layers of a hard polymer stopping layer material that are configured to prevent an inner layer of armor wires strength members from digging into the insulation materials that protect charges flowing in the serve or the conductors. This polymer or stopping layer creates a durable, high-temperature-resistant jacket over the cable core that is configured to protect the cable core both mechanically (by preventing the armor wire layer from penetrating the cable core) and thermally (by protecting the cable core against a predetermined temperature). The stopping layer may protect the components in the cable core against temperatures up to 550 to 600 degrees Fahrenheit. High temperature damage may be possible not only in a high temperature downhole environment but also during manufacturing processes (such as, but not limited to, applying infrared heat sources to soften polymers when extruding additional layers of polymer, such as the layers 108, 208, 308, 314, 318, 408, and 412 to create a caged armor jacketing system). By preventing the inner armor wire layer from penetrating the core of a cable core, the serve may also be isolated from the armor, thus increasing the operational safety of wireline cables. In high tension cables, a single armor layer may dig into the bottom layers and this stress can cause premature failure of the cable. The hard jacket or stopping layer placed between the two layers of armor wire may prevent such stress risers on individual armors and thus increase the reliability of operation using wireline cable.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings. Instead, the scope of the application is to be defined by the appended claims, and equivalents thereof.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

What is claimed is:

1. A method for manufacturing a cable, comprising:

providing a cable core comprising at least one conductor;

extruding an inner stopping layer about at least the cable core, wherein the inner stopping layer comprises a polymer layer configured to mechanically and thermally protect the cable core;

extruding a first jacketing layer about the stopping layer; and cabling a first armor wire layer about the first jacketing layer; extruding an outer stopping layer over the first armor wire layer, and cabling a second armor wire layer about the outer stopping layer.

2. The method of claim 1 wherein extruding an inner stopping layer comprises extruding a polymeric layer of Polyarylether ketone families comprising, PolyEtherEtherlKetone (PEEK), PolyEtherKetone (PEK), PolyKetone (PK), or polyaryletherketone (PAEK), and combinations thereof.

3. The method of claim 1 wherein extruding a first jacketing layer comprises extruding a fluoropolymer, wherein the fluropolymer comprises ethylene-tetrafluoroethylene copolymer (ETFE), TFE/Perfluoromethylvinylether Copolymer (MFA), ethylene-chlorotrifluoroethylene copolymer (ECTFE), perfluoroalkoxy resin (PFA), fluorinated ethylene propylene copolymer (FEP), polytetrafluoroethylene (PTFE), and combinations thereof.

4. The method of claim 1 wherein cabling comprises at least partially embedding the first armor wire layer into the first jacketing layer.

5. The method of claim 4 wherein embedding comprises embedding the first armor wire layer into the first jacketing layer while the first jacketing layer is soft.

6. The method of claim 1 further comprising extruding a jacketing layer about the first armor wire layer.

7. The method of claim 6 further comprising extruding at least one jacketing layer over the outer stopping layer.

8. The method of claim 1 wherein cabling comprises cabling at least one of a solid armor wire layer and a stranded armor wire layer.

9. The method of claim 1 wherein a one of extruding an inner stopping layer and extruding a first jacketing layer comprises extruding an amended polymer material, wherein the polymer material is amended with a plurality of strengthening members.

10. The method of claim 9 wherein the strengthening members comprise at least one of a wear-resistant particle and a fiber.

11. The method of claim 1 wherein providing a cable core comprises providing a one of a monocable, a coaxial cable, a triad cable, a quad cable, and a heptacable.

12. The method of claim 1 wherein the cable comprises a wireline cable configured for use in a wellbore penetrating a subterranean formation.

13. The method of claim 1 wherein the outer stopping layer is configured to protect the cable core from damage at an exposure about 500 to about 600 degrees Fahrenheit.

* * * * *